US011788018B2

(12) United States Patent
Hamilton et al.

(10) Patent No.: US 11,788,018 B2
(45) Date of Patent: Oct. 17, 2023

(54) PROCESSES FOR CONVERTING PETROLEUM BASED WASTE OILS INTO LIGHT AND MEDIUM DISTILLATE

(71) Applicant: Green Marine Fuels LLC, Las Vegas, NV (US)

(72) Inventors: James Eric Hamilton, Alberta (CA); Daniel Bruce Karl, Alberta (CA)

(73) Assignee: Green Marine Fuels LLC

( * ) Notice: Subject to any disclaimer, the term of this patent is extended or adjusted under 35 U.S.C. 154(b) by 0 days.

(21) Appl. No.: 17/435,609

(22) PCT Filed: Mar. 6, 2020

(86) PCT No.: PCT/US2020/021532

§ 371 (c)(1),
(2) Date: Sep. 1, 2021

(87) PCT Pub. No.: WO2020/181245

PCT Pub. Date: Sep. 10, 2020

(65) Prior Publication Data

US 2022/0154085 A1 May 19, 2022

Related U.S. Application Data

(60) Provisional application No. 62/814,405, filed on Mar. 6, 2019.

(51) Int. Cl.
*C10G 55/06* (2006.01)

(52) U.S. Cl.
CPC ..... *C10G 55/06* (2013.01); *C10G 2300/1007* (2013.01); *C10G 2300/307* (2013.01); *C10G 2300/4006* (2013.01); *C10G 2300/4012* (2013.01)

(58) Field of Classification Search
CPC ..... C10G 55/06; C10G 2300/307; C10G 2300/1007; C10G 2300/4006; C10G 2300/4012
See application file for complete search history.

(56) References Cited

U.S. PATENT DOCUMENTS

| | | | | |
|---|---|---|---|---|
| 4,512,878 | A | 4/1985 | Reid | |
| 5,534,113 | A | 7/1996 | Quigley et al. | |
| 5,885,444 | A | 3/1999 | Wansbrough | |
| 9,469,583 | B2 | 10/2016 | Aalto et al. | |
| 2003/0019789 | A1 | 1/2003 | Kwak | |
| 2012/0132182 | A1 | 5/2012 | Gunter et al. | |
| 2013/0136665 | A1* | 5/2013 | Kim | B01J 29/56 502/64 |
| 2018/0273860 | A1 | 9/2018 | Schleiffer et al. | |

FOREIGN PATENT DOCUMENTS

| | | | |
|---|---|---|---|
| CN | 103013594 | A | 4/2013 |
| CN | 106190277 | A | 12/2016 |
| WO | 1993023506 | A1 | 11/1993 |
| WO | 2017049561 | A1 | 3/2017 |

OTHER PUBLICATIONS (slideserve.com) Introduction to Petroleum Refinery Engineering; captured on Feb. 8, 2017 by web.archive.org and downloaded Apr. 20, 2020 from https://web.archive.org/web/20170208104157/https://www.slideserve.com/phoebe/introduction-t o-petroleum-refinery-engineering 1/15 ; p. 1, Petroleum Fractions Table.

* cited by examiner

*Primary Examiner* — Randy Boyer
(74) *Attorney, Agent, or Firm* — Tarter Krinsky & Drogin LLP

(57) ABSTRACT

The present technology relates to processes for converting PBWO into light and medium distillate such as usable diesel fuel, the processes generally comprising the steps of: boiling the PBWO to dehydrate the PBWO, heating the PBWO to produce PBWO hydrocarbon vapor, contacting the PBWO hydrocarbon vapor with a catalyst, and cooling the resultant vapor to liquid form through heat exchangers to produce light and medium distillate.

18 Claims, 8 Drawing Sheets

Straight Chain Hydrocarbons

| Name | Carbon Atoms Present | n-alkanes Boiling Point °C | n-alkanes Flash Point °C | Range |
|---|---|---|---|---|
| Water | H2O | 100 | - | - |
| Methane | C1 | -164 | - | NGK |
| Ethane | C2 | -89 | -139.16 | NGK |
| Propane | C3 | -42 | -106.49 | NGK |
| Butane | C4 | -0.5 | -74 | NGK |
| Pentane | C5 | 36 | -47.21 | NGK |
| Hexane | C6 | 69 | -17.4 | NGK |
| Heptane | C7 | 98 | -7.12 | NGK |
| Octane | C8 | 125 | 16.15 | Diesel |
| Nonane | C9 | 151 | 29.29 | Diesel |
| Decane | C10 | 174 | 50.45 | Diesel |
| Undecane | C11 | 196 | 69.45 | Diesel |
| Dodecane | C12 | 216 | 85.43 | Diesel |
| Tridecane | C13 | 234 | 100.32 | Diesel |
| Tetradecane | C14 | 254 | 111.3 | Diesel |
| Pentadecane | C15 | 271 | 122.55 | Diesel |
| Hexadecane | C16 | 287 | 131.67 | Diesel |
| Heptadecane | C17 | 302 | 146.83 | Diesel |
| Octadecane | C18 | 317 | 156.28 | Diesel |
| Nonadecane | C19 | 330 | 167.25 | Diesel |
| Eicosane | C20 | 343 | 175.96 | Diesel |
| Heneicosane | C21 | 357 | - | Diesel |
| Docosane | C22 | 367 | - | Lube/Fuel Oil |
| Tricosane | C23 | 380 | - | Lube/Fuel Oil |
| Tetracosane | C24 | 391 | - | Lube/Fuel Oil |
| Pentacosane | C25 | 402 | - | Lube/Fuel Oil |
| Hexacosane | C26 | 412 | - | Lube/Fuel Oil |
| Heptacosane | C27 | 432 | - | Lube/Fuel Oil |
| Octacosane | C28 | 436 | 226.81 | Lube/Fuel Oil |
| Nonacosane | C29 | 441 | - | Lube/Fuel Oil |
| Triacontane | C30 | 451 | 239.93 | Lube/Fuel Oil |
| Hentriacontane | C31 | 458 | - | Lube/Fuel Oil |
| Dotriacontane | C32 | 467 | - | Lube/Fuel Oil |
| Tritriacontane | C33 | 474 | - | Lube/Fuel Oil |
| Tetratriacontane | C34 | 483 | - | Lube/Fuel Oil |
| Pentatriacontane | C35 | 490 | - | Lube/Fuel Oil |

FIG. 6A

| | | | | |
|---|---|---|---|---|
| Hexatri | C36 | 497 | - | Lube/Fuel Oil |
| Heptatriacontane | C37 | 505 | - | Lube/Fuel Oil |
| Octatriacontane | C38 | 512 | - | Lube/Fuel Oil |
| Nonatriacontane | C39 | 518 | - | Lube/Fuel Oil |
| Tetracontane | C40 | 525 | - | Lube/Fuel Oil |
| Hentetracontane | C41 | 531 | - | Lube/Fuel Oil |
| Dotetracontane | C42 | 536 | - | Lube/Fuel Oil |
| Triatetracontane | C43 | 542 | - | Lube/Fuel Oil |
| Tetratetracontane | C44 | 548 | - | Lube/Fuel Oil |
| Pentatetracontane | C45 | 553 | - | Lube/Fuel Oil |
| Hexatetracontane | C46 | 558 | - | Lube/Fuel Oil |
| Heptatetracontane | C47 | 564 | - | Lube/Fuel Oil |
| Octatetracontane | C48 | 569 | - | Lube/Fuel Oil |
| Nonatetracontane | C49 | 574 | - | Lube/Fuel Oil |
| Pentacontane | C50 | 578 | - | Lube/Fuel Oil |
| Henpentacontane | C51 | 583 | - | Lube/Fuel Oil |
| Dopentacontane | C52 | 588 | - | Lube/Fuel Oil |
| Tripentacontane | C53 | 592 | - | Lube/Fuel Oil |
| Tetrapentacontane | C54 | 596 | - | Lube/Fuel Oil |
| Pentapentacontane | C55 | - | - | Lube/Fuel Oil |
| Hexapentacontane | C56 | - | - | Lube/Fuel Oil |
| Heptapentacontane | C57 | - | - | Lube/Fuel Oil |
| Octapentacontane | C58 | - | - | Lube/Fuel Oil |
| Nonapentacontane | C59 | - | - | Lube/Fuel Oil |
| Hexacontane | C60 | - | - | Lube/Fuel Oil |

FIG. 6B

PROCESSES FOR CONVERTING PETROLEUM BASED WASTE OILS INTO LIGHT AND MEDIUM DISTILLATE

BACKGROUND

The present technology relates to processes for manufacturing light and medium distillate such as diesel fuel, in particular, processes that can uniquely convert petroleum based waste oil (PBWO) into light and medium distillate, in particular, medium distillate diesel blendstock such as a low sulfur, high cetane, medium distillate blendstock.

Much of the global economy is fueled by fossil fuels. The engines that burn those fossil fuels, such as diesel, natural gas, gasoline or propane, all require some type of engine oil, also referred to as lubricating oil (or "lube oil"). This lubricating oil gets contaminated from use over time, resulting in petroleum based waste oil (PBWO), including oils such as used engine oil or used motor oil (UMO). Such PBWO must be changed out periodically during the time that an engine is in operation. Drivers in the United States alone produce nearly 2 billion gallons per year of UMO, of which only about 10 to 15% is ultimately recycled or re-refined. The majority of this oil, and other PBWO, ends up contaminating groundwater around the globe. It is frequently burned as a "dirty fuel" leading to high emissions and greater air pollution; or else dumped in landfills and elsewhere. This waste stream of PBWO needs to go where it can be properly managed and prevent further negative environmental impact.

Currently, the PBWO that does not end up dumped somewhere in the environment is generally re-refined back into a base oil, blended with other types of fuel, or burned as a heating oil substitute. However, burning waste oil has extremely high emissions due to contamination, even when blended with other types of fuel; it is also environmentally damaging, and is illegal in many jurisdictions, including most of North America. This waste product stream needs to be properly managed in order to prevent further negative environmental impact.

As stated above, in the United States, only about 10 to 15% of waste oil makes its way to a recycling re-refiner or processor. The U.S. Department of Energy estimates that at least 80% of PBWO is ultimately burned.

Current used oil recycling technologies and processes are scarce, and use either: (1) high pressure processes with hydrogen injection; or (2) vacuum distillation combined with a hydro-cracker or deasphalter. While these processes can recycle PBWO or rerefine it back into a base oil product, they have many disadvantages. Among them, such current processes are unable to produce a clean, high quality, light & medium distillate fuel. Moreover, existing technologies require expensive equipment, large facility footprint, and high energy input in order to achieve desired results. Further, existing technologies are limited only to re-refined lubricating oil, which results in lower quality oil that is suitable only for heating, or a base oil product. There are currently no known processes that can produce a high-quality, low sulfur diesel fuel or diesel blendstock product.

Therefore, an ongoing need exists for a process that can take surplus waste streams such as petroleum based waste products, and turn them into a renewable fuel source by recycling or processing it into a high quality, clean burning fuel. In particular, processes that do not require extremely high pressures, or a large facility with extremely high capital expenditure costs, would be particularly desirable.

SUMMARY

In certain embodiments, the present technology is directed to a process for converting petroleum based waste oil (PBWO) to light and medium distillate, the process comprising the steps of:

(a) mixing and heating the PBWO, in a pre-boiler containing a mixer, to a temperature and for a period of time sufficient to remove at least 90% of the water in the PBWO;

(b) further mixing and heating the dehydrated PBWO, in a main boiler containing a mixer, to at least 300° C. to produce: (i) a first vapor stream of light end hydrocarbons, the light end hydrocarbons including one or more of naphthalene, gasoline or kerosene; and (ii) a first vapor stream of heavier hydrocarbons including at least 50% C8-C25 hydrocarbon chains;

(c) directing the first vapor stream of heavier hydrocarbons from step (b) to a catalyst tower containing an aluminum silicate catalyst to crack the heavier hydrocarbon chains to shorter hydrocarbon chains; to produce: (i) a second vapor stream of light end hydrocarbons, the light end hydrocarbons including one or more of naphthalene, gasoline or kerosene; and (ii) a mixed vapor and liquid stream of heavier hydrocarbons including at least 50% C10-C15 hydrocarbon chains;

(d) directing the mixed vapor and liquid stream of heavier hydrocarbons from step (c) to a stripper that separates the vapor from the liquid to provide separate vapor and liquid streams, wherein the liquid stream exiting the stripper includes at least 60% C10-C15 hydrocarbon chains.

In certain embodiments, the present technology is directed to light and medium distillates produced through the processes described herein.

BRIEF DESCRIPTION OF THE DRAWINGS

FIGS. 6*a-b* shows boiling points and flash points for known straight chain hydrocarbons, and their classification as types of fuel.

DETAILED DESCRIPTION

Figure 1:
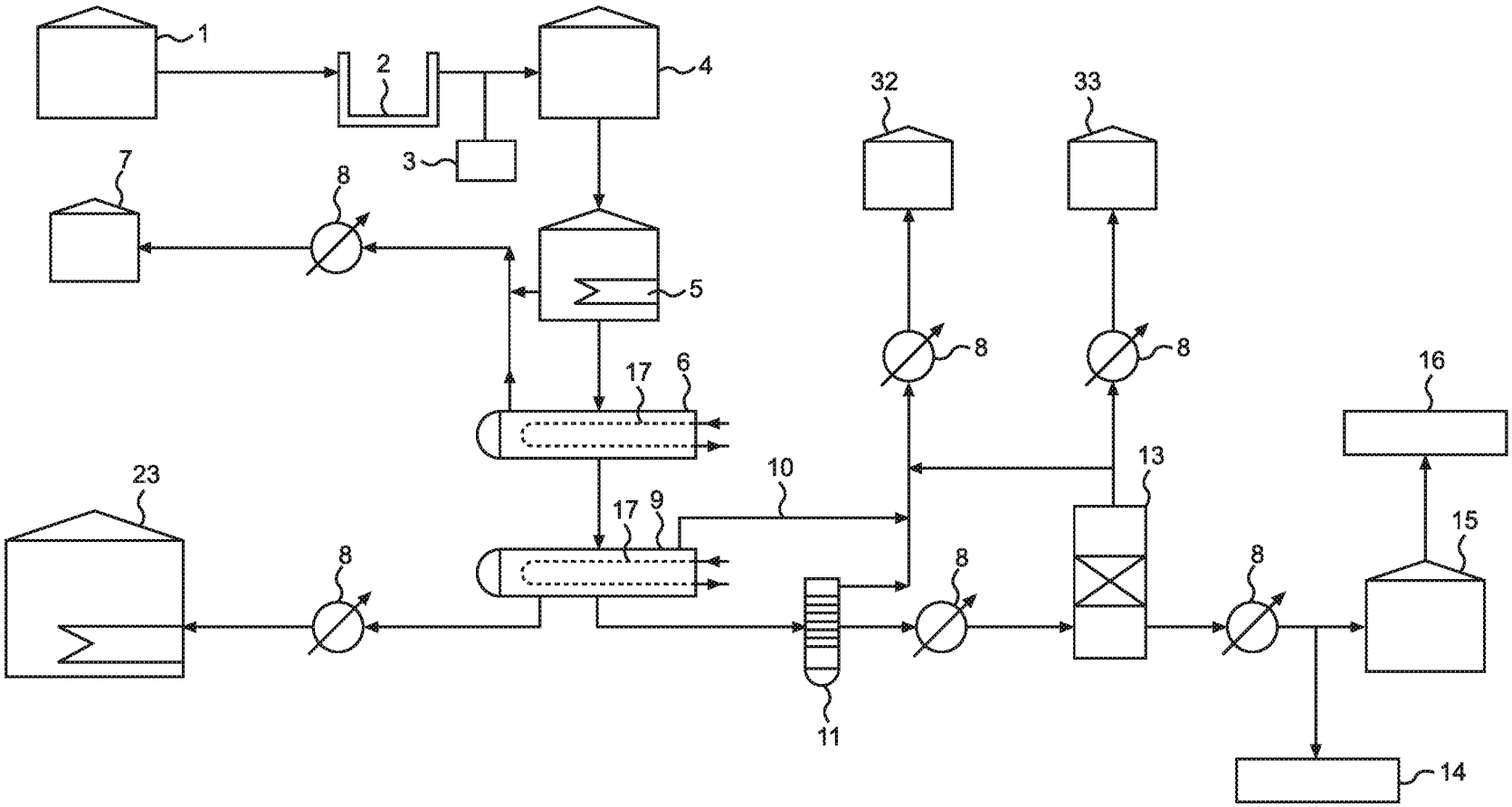
FIG. 1 shows an exemplary process according to certain embodiments herein.

All percentages expressed herein are by weight, unless otherwise indicated. It is noted that throughout the present disclosure, reference made to any numbered items in the Figures are for example only, and the embodiments herein are not limited to the depictions of such items in the Figures.

As used herein, "petroleum based waste oil," "PBWO," used motor oil (UMO), "No. 6 oil," "waste oil," "waste lubricating oil," "waste lube oil" and "WLO" are all used to mean a blend of petroleum based hydrocarbons that has been used in various ways (including for powering internal combustion engines, for general lubrication, for heating and any other uses for which petroleum based hydrocarbons are typically used) but not yet subjected to the processes described in the present technology. In certain embodiments, the processes herein include feedstock having a C# ranging anywhere from C10 to C60, for example, primarily C20 to C50, however, the processes and methods of the present technology are capable of processing a large range of petroleum based and lubricant compositions and mixtures, as can be seen, e.g., in FIG. 7. In certain embodiments PBWO feedstock may be blended with other available fuels, for example, fuels that no longer meet quality standards. In certain embodiments, the processes herein can also involve the addition of High Sulfur Fuel Oil (HSFO), for example, that known as a "bunker fuel," which can be blended with feedstock to improve quality and remove sulfur, resulting in a cleaner burning fuel. In such embodiments, when referring to "PBWO" this includes the PBWO blended with the HSFO that is fed into the processes herein.

As used herein "substantially" means within 10% of a quantitative value. For example, "substantially equal to" means within 10% of the same value; "substantially full" or "substantially empty" mean within 10% of full or empty, respectively.

As used herein, "PBWO hydrocarbon vapor" refers to the PBWO in the process at the point where it has been boiled to a desired temperature, and then exits the boiler and is headed to be exposed to the catalyst. As used herein, "diesel hydrocarbon vapor" means the output of the processes at the point where the hydrocarbon vapor has been exposed to the catalyst. It can include, and be interchangeable, with the term, "light to medium distillate fuel." As used herein, "medium distillate," "diesel," "low sulfur diesel, also covers "distillate fuel oil" and "marine gas oil (MGO)." It is of note that different countries have different terms for low sulfur diesel products. When referring to any input or output stream in any step of the processes described herein, these streams can comprise, in various embodiments, vapor, liquid or a mixture of vapor and liquid. As used herein in reference to the final product of the processes, the use of "diesel" or "in the diesel range" refers to a hydrocarbon mixture composed of molecules that have a C-Number or C# primarily from C8-C25, with the average being in the range of C10-C15, or approximately C12. Within these hydrocarbon chains of the same C-Number, there are variations in the molecule's structure or shape. Thus, each diesel sample tested from different refineries could result in very different physical properties such as viscosity, density or flash point.

As used herein, "boiler" refers to any element of the processes herein that heats up the PBWO as part of the steps to vaporize the different hydrocarbon compounds in the PBWO. "Boiler" can refer generally to either a "pre-boiler" (also known as "boiler first stage") and "main boiler" (also known as "boiler second stage"). As used herein, the term "boiler" is used interchangeably with the term, "kettle."

As mentioned above, current processes for recycling or re-refining used motor oil have numerous disadvantages. Included among them are high costs, high energy input requirements, and limited end products. In contrast, processes according to the present technology are able to achieve desirable results while keeping the overall pressure relatively low, and applying heat. Further, the processes herein permit recycling or re-refining of PBWO, typically a waste product stream in most applications today, into a premium low sulfur diesel product, thus taking a "greener" approach to a typical a crude oil refinery. Because a waste product (rather than crude oil) is being used as feedstock, the processes herein advantageously permit production of diesel fuel at a much lower cost than that of current existing technologies. The economics of such processes are also extremely advantageous; compared with costs of a traditional refinery for $CapX:BPD (Flowing Barrel Per Day). Production costs of the present methods and processes can be a fraction of those of the traditional refinery.

In certain embodiments, the feedstock for a process according to the present technology is petroleum based motor oil (PWBO) such as used motor oil (UMO). In certain embodiments, the PBWO can be one or more (e.g., a mixture) of petroleum-based lubricants or fuel blendstocks. These can include, but are not limited to: motor oil, transmission oil, gear oil, hydraulic oil, compressor oil, group's 1, 2, 3 base oils, high sulfur fuel oil (HSFO), any of a variety of types of fuel oil No. 6 available on the market (for example, 3.5%, representing up to 35,000 ppm sulfur content as set by industry standards; or 1%, representing up to 10,000 ppm sulfur content as set by industry standards; as well as other petroleum-based lubricants such as, but not limited to: automatic transmission oil, power steering oil, gear oil, kerosene, mineral spirits, mineral turpentine, turpentine substitute, petroleum spirits, paint thinner, solvent naphtha (any of which can be referred to under the trade name Varsol), turbine engine oil, hydraulic oil, synthetic heat transfer oil, synthetic hydraulic oil, animal oil or vegetable oil. In certain embodiments, the PBWO can comprise waste oil blended with fuel oil (not used, but rather new fuel oil, in certain embodiments of the same quality or lower quality) and once refined by a process herein, will produce a higher quality, lower sulfur, cleaner burning fuel.

In certain embodiments, the overall processes herein generally include the following steps: the PBWO is heated in a boiler, which leads to vaporization of the PBWO. The boiler can include a number of mixers, which keep the PBWO constantly stirring to maintain homogeneous temperature throughout the fluid. Vapor that results from the heated PBWO can be collected, and this vapor can be fed into a chamber with a catalyst, wherein carbon chains are broken (that is, the molecular structures of the molecules are altered) and the components of the PBWO are isolated, producing the final product of, in various embodiments, light to medium distillate, medium distillate diesel blendstock, or diesel fuel.

Figure 2:
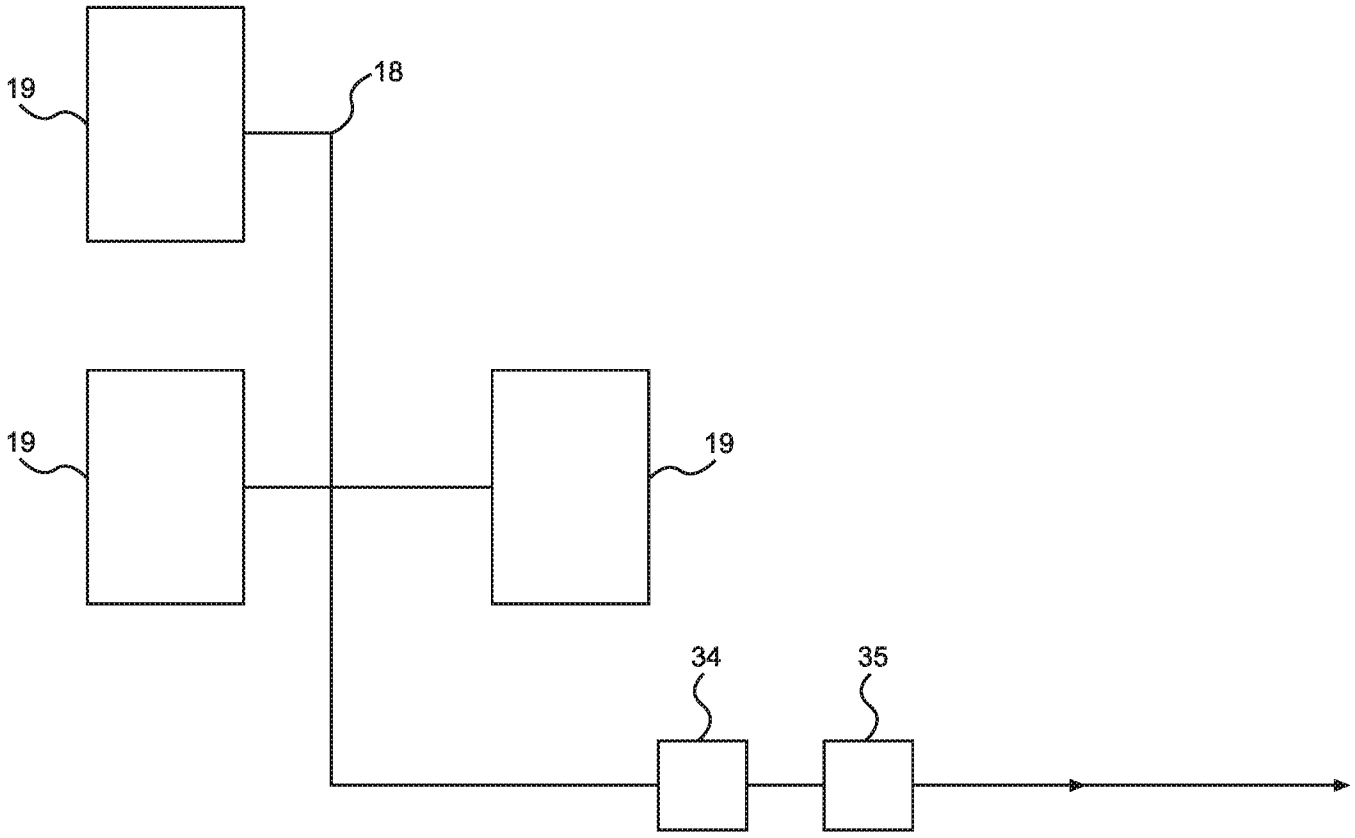
FIG. 2 shows a detail of the tanks used for providing input of raw material at the beginning of an exemplary process according to certain embodiments herein.
Figure 4:
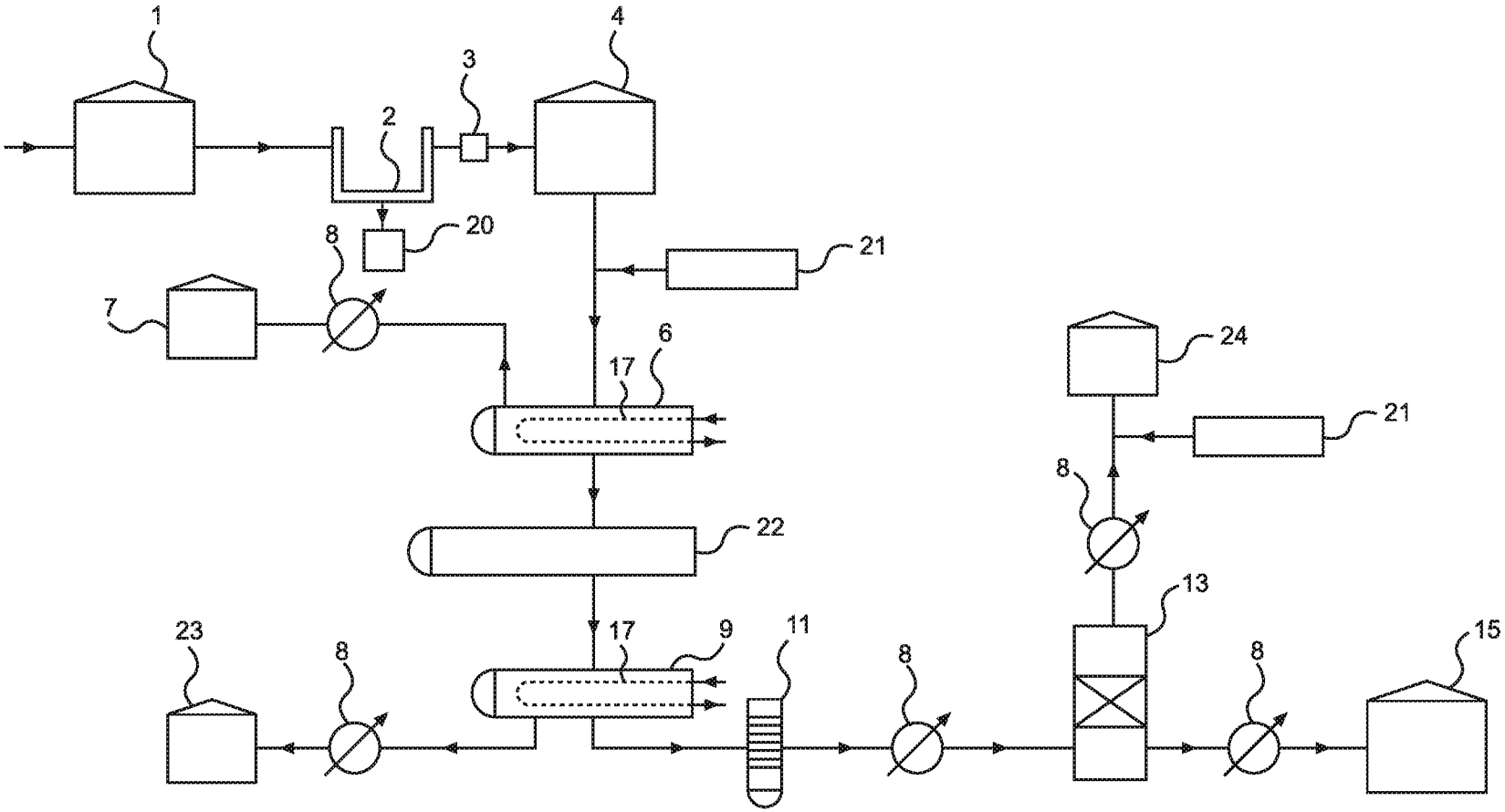
FIG. 4 shows an exemplary process according to certain embodiments herein, showing a 2 stage heating configuration.

Turning to each general step in more detail, in certain embodiments, a process according to the present technology is described as follows, and shown in an exemplary embodiment in FIG. 1. First, the feedstock can be, in certain embodiments, pre-filtered to remove large particles & contaminates. The PBWO can then be placed in one or more tanks for a supply of feedstock for the plant process, for example as shown in FIG. 1, FIG. 2 and FIG. 4.

In certain embodiments, the processes herein can be performed as a "batch" process. In such embodiments, the boiler can simply be loaded with PBWO and then heated until the majority of the PBWO is vaporized, and the vapor collected and subjected to the catalyst.

In other embodiments, the processes herein can be performed as a "semi-continuous" process (also known as a "slip stream" process). In such embodiments, the processes can use temperature or fluid level regulated pumps. In some embodiments, these pumps are equipped with variable frequency drives (VFDs). These can allow a boiler to maintain a constant temperature, and the PBWO can be slowly pumped into a boiler at a rate substantially equal to the rate of PBWO being vaporized. Any embodiment herein can be adapted to work as a batch process or a semi-continuous process, or even a fully continuous process.

In still other embodiments, the feedstock PBWO is off-loaded into storage tanks, thereby maintaining a continuous feedstock of PBWO for the process, although this is not necessarily a fully continuous process. In various embodiments, the storage tanks can be equipped with heaters to begin heating PBWO prior to entering the boiler (depending on geographic location and temperature conditions). In certain embodiments, PBWO goes from a pre-heating tank into a single boiler that heats all the way up to diesel production phase (for example, up to 120° C., up to 125° C., up to 130° C., up to 150° C., up to 175° C., up to 200° C., up to 250° C., up to 300° C. or up to 400° C.; or up to a range of 145 to 450° C., or up to a range of 175 to 400° C.), or 300 to 375° C. or 325 to 400° C.; and this boiler is sufficient to accomplish all of the required heating to produce all of the desired products (for example, water, NGK, light distillate, medium distillate and any leftover residues that do not boil at the expressed temperatures). Such embodiments can desirably accomplish the entire process with a single boiler, and can be useful for smaller scale production, such as micro-scale production.

In other embodiments, PBWO is heated in a tank and then in a series (two or more) of pre-heating and production boilers for higher volume output. In such embodiments, there can be a series of heating vessels to bring the PBWO up to the desired temperature. That is, in such embodiments, in order to increase process volume throughput & reduce cyclic thermal stress wear on equipment (expansion & contraction over time), a process can include multiple stages of heating, through heated tanks, pre-heat boilers, or production boilers as part of the process. In certain embodiments, the PBWO in one or more of these stages can be in the range of 125 to 450° C., 150 to 425° C., 175 to 400° C., 200 to 450° C., 200 to 400° C., 225 to 450° C. or 225 to 400° C.

Returning to the beginning of a multi-boiler process described herein, in certain embodiments, the PBWO is then pumped from the tanks into an initial pre-heating boiler, where it is heated up to a high temperature, in various embodiments, in a range such as: 70 to 150° C., 100 to 150° C., 100 to 130° C., 110 to 140° C., 115 to 135° C., 120 to 135° C., at least 200° C., at least 250° C., at least 300° C., at least 350° C., at least 400° C., or 400 to 450° C. The temperature ranges can depend on various factors, including but not limited to: the efficiency of the heated tank, and the temperature of the oil before it goes into the pre-heating boiler. Heating the PBWO in this step can have the effect of dehydrating or dewatering the oil, as well as removing any other light end petroleum products that have a boiling point below the expressed temperature range (for example, trace gasoline contamination in the PBWO). In certain embodiments, these can be boiled off and captured by a vapor recovery system (VRS).

Water is a common contaminant of PBWO introduced in a small part during oil's operational life in engine. It can bond with or attract oil over time, forming, "emulsified water," which is very difficult to remove from PBWO and does not always boil at 100° C. due to attractive forces formed with PBWO. The majority of water is introduced as a contaminant during PBWO's collection, transportation, and storage. It is desirable to remove such water, and the processes herein are desirable in their ability to do so. In certain embodiments, water vapor can come off the top of initial pre-heating boiler, through a heat exchanger where the temperature can be lowered or condensed from a vapor to a liquid state (in certain embodiments below 60° C., below 50° C., below 45° C., below 40° C., or in the range of 20 to 65° C. or 30 to 45° C.), and the resultant liquid can flow to a wastewater holding tank, or for other uses. In certain embodiments, the removed water is ultimately condensed to ambient temperature—for example, in a temperature range of 20 to 30° C., 20 to 25° C. or 20 to 35° C.

Agitators/Mixers

In certain embodiments, the inside of one or more of the boilers can be equipped with one or more electric mixers (also referred to interchangeably herein as agitators) in order to achieve at least a substantially homogeneous temperature throughout the oil bath. Mixers or agitators can be present on any of the boilers in the present embodiments (that is, any pre-boiler or boiler), and can create motion or turbulence within the PBWO to permit a homogenous temperature in the mixture, as well as assisting water or hydrocarbon molecules to escape the liquid mixture when they have reached their respective boiling points and leave a boiler vessel through vapor lines. In certain embodiments, the one or more agitators or mixers comprise one or more of the following: an electric motor, a gear box, or thermal packaging; any of which can in certain embodiments be inside or outside the boiler; causing a mixing shaft to rotate within the boiler. In certain embodiments, these agitators or mixers can include paddled mixing rods, propeller type mixing wing, mixing paddles or beater type mixers, any of which can be located at various elevations within the boiler.

In certain embodiments, any one or more of the following can further be included: a sparging system, a spray nozzle or a pump mounted outside the boiler. These can be used in conjunction with the one or more agitators or mixers, or used independently to create the required agitation. In certain embodiments, a process herein includes a sparging system with a recycle pump.

In various embodiments, the one or more mixers or agitators can run at speeds of 2 to 250 RPM or 5 to 150 RPM or 10 to 100 RPM or 15 to 75 RPM or 20 to 60 RPM or 30 to 55 RPM for at least part of the boiling step, or the entirety of the boiling step. In certain embodiments, any given boiler can include multiple agitators, e.g., any number from 1 to 10 agitators per boiler. Each agitator can run at its own speed, the same or different from any other agitator(s). Adequate mixing can be beneficial to the processes discussed herein, as well as prolonging the operating life of boiler equipment, and preventing hot spots and the formation of coke (that is, asphaltenes and heavy oil molecules that can be baked into the vessel and tubing), greatly reducing the rate of heat transfer. In certain embodiments, a boiler herein is configured such as one or more agitators are turned on and kept on—that is, agitate the PBWO—for at least 50%, at least 60%, at least 70%, at least 80% or at least 90% of the time any PBWO is within the boiler. In certain embodiments, counting from the time that any PBWO first enters the boiler, an agitator herein can be turned on and used to agitate the PBWO from 1 to 180 minutes, from 10 to 150 minutes, 20 to 120 minutes, 30 to 100 minutes, 40 to 90 minutes, 50 to 90 minutes, 60 to 120 minutes or 60 to 90 minutes.

Figure 5:
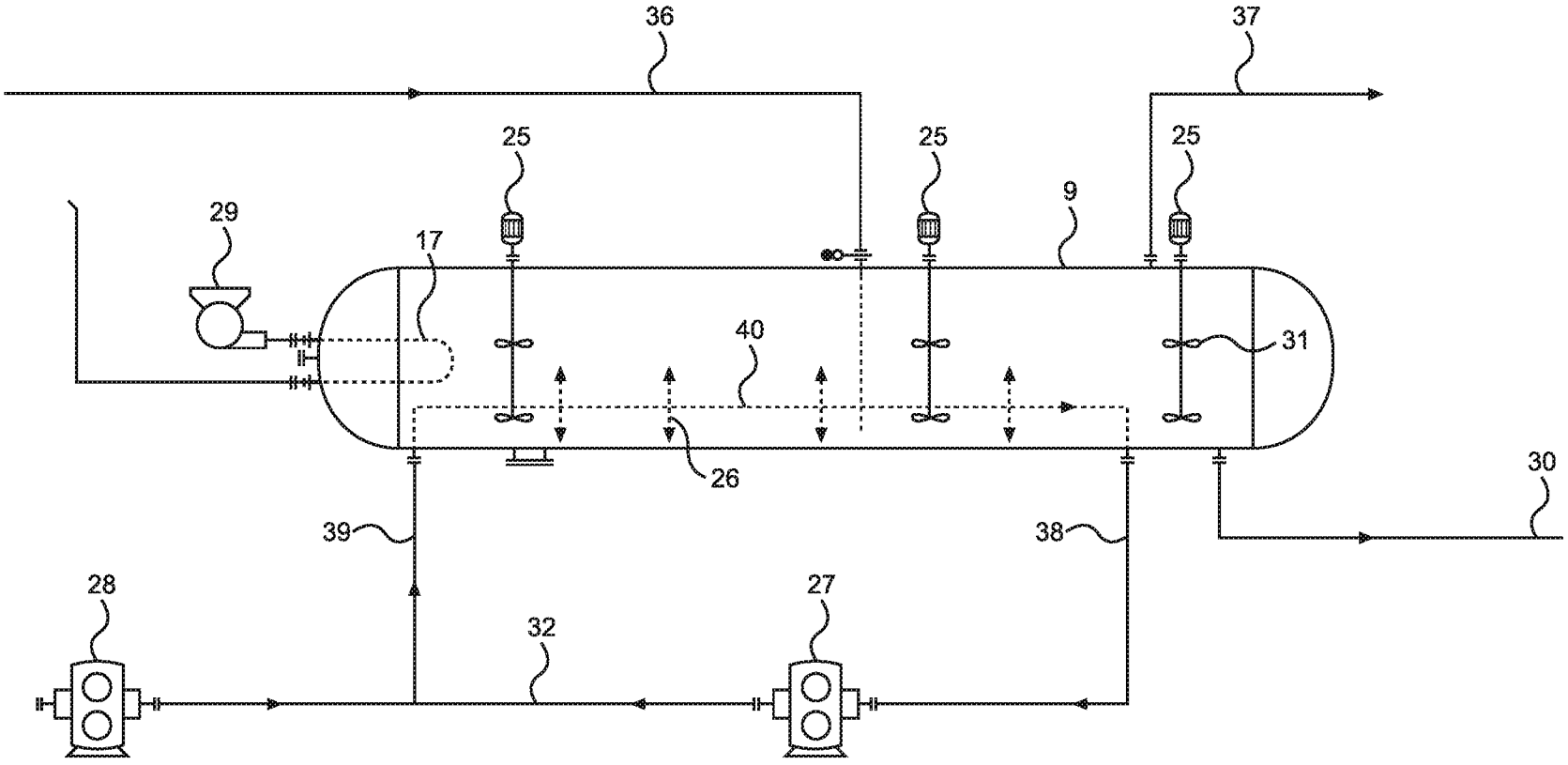
FIG. 5 shows a process flow diagram (PFD) of a boiler according to certain embodiments herein.

In certain embodiments, for example as shown in FIG. 5, a boiler 9 is set up with a burner 29 that blows hot air into the boiler 9 through a fire tube 17 for reacting the PBWO that comes in through the PBWO feed line 32 that is pumped in by the PBWO feed pump 28. In the embodiment shown in FIG. 5, the boiler 9 includes one or more mixers 25; these mixers can be equipped with one or more paddles 31, which turn and agitate the liquid within the boiler. In certain embodiments, a mixer 25 is composed of electric motor, gear box, and a unique graphite packing that seals around the mixing shaft, while still allowing it to rotate.

An exemplary mixer as described herein, e.g., 25 in FIG. 5, can have two levels of paddles 31 attached to the shaft inside the boiler, one above and one below the fire tube. While in FIG. 5 the fire tube 17 extends only partially into the boiler 9, in other embodiments the fire tube can extend farther into the boiler 9, or even within substantially the entire length of the boiler 9. In certain embodiments, the agitator paddles 31 can move through a viscous PBWO mixture and create a vacuum effect on the tailing edge. This can keep the liquid PBWO in motion, to prevent hot spots within the boiler, but also creates the effect of snapping quickly, creating a vapor pocket in the bottom of the liquid. The vapor pockets that form can assist in the overall separation and vaporization of PBWO mixture. This plays a large part in lowering the required temperature for vaporization of heavier hydrocarbon chains, and permitting great savings in input energy and subsequent costs.

Another advantage of the agitation systems herein is how they allow hydrocarbon molecules to react when they contact the internal fire tube 17. Naturally the fire tube surface is the hottest part of the boiler, and is where the primary heat transfer takes place. This results in some thermal cracking of hydrocarbon molecules. When PBWO is thermally cracked it creates something referred to as "gum" from the additives present in PBWO. To prevent gum build up on the fire tube the agitators can be an important advantage, as is the sparging/recycle system that assists in agitation of PBWO in boiler, as described as follows:

In certain examples, e.g., as shown in FIG. 5, the boiler 9 further includes one or more sparging headers (also known as injection nozzles) 26 (which are part of a manifold with one or more nozzles used to assist in mixing/agitation). These injection nozzles 26 lie along a length of sparging pipe 40, which draws PBWO in, and recycles it through a recycle/sparging pump 27 that works in conjunction with the PBWO feed pump 28, and load the PBWO back into the boiler 9 through the sparging system as other oil is vaporized.

In certain embodiments, one or more boiler herein is subject to constant, or substantially constant agitation while the PBWO therein is subject to heat. This has been found to increase the efficiency of the conversion of the PBWO to both light and medium distillate products through the processes herein.

Boiler

In certain embodiments, after being boiled in the boiler 9, in certain embodiments, as further shown in FIG. 5, the heavy distillates (or "heavies") flow out of the boiler through the residual drain line 30, and then removed from the processes. The boiler can also include a vapor line 37 of the product, which flows from the boiler 9 to a catalyst tower 11 (not pictured in FIG. 5).

In certain embodiments, a boiler in the processes herein includes an internal fire tube 17 in order to maximize surface area and heat transfer from a burner flame, into the waste oil bath. Pre-heat boilers can be rated for temperatures of 150° C. or higher, and can, in certain embodiments, use carbon steel fire tubes. As used herein, a "fire tube" (also known as an "internal fired heating element" or "internal fired heating tube") is an internal tube that helps to maximize heat transfer within a boiler vessel, rather than just providing heating from the bottom of a tank. In certain embodiments, a fire tube can be used in any boiler, whether a pre-boiler/boiler first stage or a main boiler/boiler second stage. In certain embodiments, a fire tube 17 herein starts on the outside of the boiler where the burner is mounted on the end, extends to the other end, and is the bent and comes back out the same end it went in. The burner shoots a flame inside the fire tube (in various embodiments natural gas or propane), heating it the entire way, and then the exhaust is vented where it comes out. The purpose of the fire tube can include the ability to pass internally through the PBWO, contacting the oil and heating it more quickly and efficiently than would be the case if the vessel were merely heated from the bottom. In certain embodiments, the fire tube can contain baffling in order to create additional turbulence in the flue gas passing through it, thus further improving the heat transfer efficiency. In certain embodiments the fire tube exits the boiler vessel through a stack or exhaust stack, and in certain embodiments such stack includes a choke or baffling component to create additional back pressure on flue gas passing from the fired burner through the fire tube, still further increasing the heat transfer efficiency of the fire tube.

In the embodiment shown in FIG. 5, a boiler 9 can be used in connection with a PBWO feed pump 28 during a continuous process. In an embodiment directed to a batch process, the PBWO would flow into the system via a still well 36. For illustration, both options are shown in FIG. 5.

In certain embodiments, the processes herein contemplate pre-heating the PBWO up to a temperature sufficient to remove substantially all of the water, or at least 90% or at least 95% of the water in the PBWO. At a point when the oil has been sufficiently dehydrated as defined herein, or when no more water vapor is being produced, the PBWO can then be pumped into one or more production boilers 9 (also described, in certain embodiments, as the "main boiler" or "boiler second stage" or in the case of a single boiler process, merely the "boiler"). In the case of two or more of such production boilers, these can, in certain embodiments, operate in series or in parallel. The production boilers can be similar in design and configuration to a pre-heating boiler, but can be designed for higher temperatures, e.g., temperatures of 400° C. or higher, or 425° C. or higher. As a result, in certain embodiments, such production boilers can require an alloy, or a super-alloy material to be used for the fire tubes. In this second heating phase of the process the waste oil temperature can be taken from, in certain embodiments, 120 to 450° C., 120 to 350° C., 120 to 375° C., 120 to 400° C., 130 to 250° C., 130 to 375° C., 130 to 400° C., 130 to 425° C. or 130 to 450° C., or 70 to 300° C., or 120 to 400° C., or 400 to 450° C., over the course of several hours (for example, 1 to 48 hours, or 5 to 24 hours or 1 to 10 hours or 2 to 24 hours or 2 to 8 hours). As discussed earlier, applying constant agitation at the speeds discussed herein within the fluid can prevent coke build up (that is, asphaltenes and heavy oil molecules that are baked into the vessel and tubing) within boiler and on the Fire Tube.

In certain embodiments, using this distillation process described herein, lighter hydrocarbon molecules can be vaporized first. In embodiments wherein the oil bath temperature ranges from 130° C. to 250° C., or in any other embodiments, the produced vapors (referred to herein as the, "first vapor stream of light end hydrocarbons") can be a mixture of light distillates (also referred herein as "light end hydrocarbons"), including but not limited to one or more of: naphthalene, gasoline or kerosene. When together, this mixture if referred to as, "Naphthalene, Gasoline, and Kerosene" (NGK). In certain embodiments, the NGK contains a mixture of hydrocarbons with C numbers of C5 to C11. In such embodiments, this vapor is channeled through a vessel (for example, a catalyst tower) containing a catalyst bed, where it heats and activates the catalyst prior to reaching the medium distillate production range. In certain embodiments, the catalyst is activated when heated up to 200° C. or higher; for example, using electric ceramic heating pads on the exterior of the catalyst vessel; or by channeling NGK vapor through the catalyst to provide heat thereto, causing cracking of NGK hydrocarbons and absorption of sulfur from the NGK vapor. The catalyst can be pre-heated in order for hydrocarbon cracking to occur. This can be accomplished by wrapping the catalyst tower with electrical heading pads or steam tracing, or heating internally through channeling vapor through the tower.

In certain embodiments, the first vapor stream of light end hydrocarbons, which can include but is not limited to NGK vapor, can then pass through a heat exchanger (HX) to be cooled down to, in various embodiments, below 60° C., below, 55° C., below 50° C., below 45° C., below 40° C. or below 35° C., to eliminate the volatility and combustion risk. In certain embodiments, the vapor is cooled down to atmospheric temperature as quickly as possible. Quicker cooling will bring the vapor to liquid and minimize the amount of vapor coming out of the tanks in the process. As used herein, "atmospheric temperature" is the ambient temperature at the location of the process, and can range from, in various embodiments, −30 to 0° C., −3° C. to 25° C., 18 to 25° C., 20 to 25° C., 20 to 30° C. or 20 to 35° C. At this point, it can be sent to a holding tank, and can undergo a filtration process to remove any possible contaminants.

In certain embodiments, vapors (such as the light end hydrocarbons) that are not condensed to liquid can be easily trapped by the surface tension of the other hydrocarbons, and a stripper (also known as a "degasser vessel" or "fractionation vessel") can be used to atomize the stream of vapor, by creating turbulence to break the surface tension of the liquids, allowing the gases to escape.

In certain embodiments, nitrogen can be injected to assist with the agitation and allow additional light ends to be separated. In such embodiments, the vapor that escapes can be sent to a Vapor Recovery System (VRU) that captures all light ends that remain in vapor state. These products that remain in vapor state can then be directed through piping to a flare stack that can be incinerated to prevent them from contaminating other fuels. In alternative embodiments, the recovered vapors can be recycled to heat the system, for example, by being sent through a blower and then a heater, then reheated to heat the system. In certain embodiments, a blower that pressurizes vapor can be re-injected into the fuel gas stream of the burner where it is combusted, and the heat value can thereafter be recovered by the system.

In the holding tank of NGK, in certain embodiments, medium distillate (whether in the form of medium distillate hydrocarbon vapor, or liquid or any other form) slowly begins being produced when temperatures of the oil bath in the production kettle climb over 250° C. In certain embodiments, mixing by mixers at 2 to 90 RPM with 1 to 4 agitators can preserve uniform temperature within the liquid, which can allow the lightest hydrocarbon molecules to vaporize at lower temperatures. This can ensure that the heaviest hydrocarbon chains, also known as "heavies" (e.g., heavy tar substance, or bunker) stay in the boiler. In certain embodiments, this leftover residue can be applied to other uses, for example, production of asphalt.

Catalyst

As these larger hydrocarbon molecules vaporize and contact "cracking" catalyst, the long waste oil hydrocarbon chains can be broken into smaller chains in the diesel range. Heavies can be broken into medium and light distillates. As used herein, "medium distillate," "diesel product" and "diesel range" are interchangeable, and mean hydrocarbons having carbon chains of 8 to 21 carbon atoms per molecule, for example, $C_{10}$ to $C_{15}$, with a mean value of $C_{12}$.

Some molecules can have too much contact with the catalyst, this can result in over-cracking, producing some "light-end" gases, and NGK. In order to separate the second set of formed NGK and medium distillate liquid or vapor, in certain embodiments the vapor passes through a multi-stage cooling process, combined with a stripper or degasser (for example, shown on the right side of FIG. 1, and in FIG. 5).

Stripper

In various embodiments, the processes herein include a stripper (also known as an "expansion tank," "degasser" or "fractionation vessel").

In certain embodiments, in the first stage of cooling in the diesel phase, hydrocarbons within the diesel range mix with a range of newly formed lighter-end hydrocarbons, such as those in the NGK range, can pass through heat exchanger, as shown, for example, in FIG. 1. In certain embodiments, the first medium distillate heat exchanger cools vapor down to, e.g., 150 to 200° C., 150 to 170° C., 165 to 185° C., or 175 to 200° C. Generally, at this point, some of the mixture is in a vapor phase, and some is in a liquid phase. This mixture can then flow into the stripper (in certain embodiments, a single tank but could be multiple tanks). Such a tank is designed to break the surface tension of the mixture. In certain embodiments, the liquid can fall to bottom of the stripper, vessel, and vapor can be allowed to exit through the top. In further embodiments, one or more of these now separated products (medium distillate & NGK) can then pass through a second phase of cooling where the heat exchanger outlet temperature is, in various embodiments, 30 to 45° C. or 25 to 55° C. In certain embodiments, one or both of these fluids is then sent to holding tanks, prior to going through a filtration process.

In certain embodiments, light distillates (also known as light ends or light end hydrocarbons) are formed throughout the process from both thermal cracking and catalytic cracking. When such products are cooled after passing through the one or more heat exchangers (in various embodiments, 20 to 75° C., 30 to 65° C., 30 to 45° C., 40 to 65° C. or 50 to 65° C.), they eventually reach atmospheric temperature, at which point the light ends remain in a vapor state. Because the carbon chains are shortened, this can result in a lower boiling/vapor point. In certain embodiments, the overall temperature range of these light ends is 15 to 120° C., such that the gases can remain trapped in liquid, unable to break the surface tension of the liquid and escape.

To contain this vapor and ensure safe operation of the facility, in certain embodiments the processes herein are part, or all, a closed loop. As used herein, "closed loop" means that all inputs into the system are is sealed to prevent any vapor from escaping or atmospheric air from entering. This can prevent the presence of oxygen and therefore avoid accidental combustion. In certain embodiments, the only locations that are open to atmosphere are the UMO tank vents, and the enclosed flare or incinerator at the output end of the system.

FIG. 1 and FIG. 4 show embodiments a system herein, wherein the PBWO is first loaded into a treater (a type of pre-heater), also known herein as "boiler first stage" 6, and then boiled in a heater, also known herein as "boiler second stage" 9. In certain embodiments, a process herein includes a secondary degasser. FIG. 2 shows tanks 19 connected to a common header or pipe 18 and pump skid 34, with optional particle and magnetic filter skid 35.

In certain embodiments, a process according to the present technology is directed to catalytic cracking (de-polymerization) of PBWO into diesel fuel. Exemplary processes are shown in FIGS. 1-5.

As can be seen from FIG. 2, in certain embodiments, the PBWO is stored in more than one PBWO tank (in this example, three) as a first step, before being fed into a boiler. In certain embodiments PBWO is stored in a series of tanks, as PBWO is pumped between holding tanks it passes through a series of filtration and removal of unwanted contaminants. In some embodiments, PBWO passes through particle filters to remove solids; in some embodiments, PBWO also passes through a magnetic filtration unit to remove suspended metals from oil. The source of metals as a contaminant is usually small particles from engine wear from its use as a lubricant, or scaling that gets picked up as rust flakes from storage tanks or during collection, transportation & storage. In certain embodiments, there can be any number of PBWO tanks, boilers and catalyst towers; for example, 3 PBWO tanks and 2 boilers (also known as "kettles"), as well as a series of pumps in parallel and a filtration element.

Figure 3:
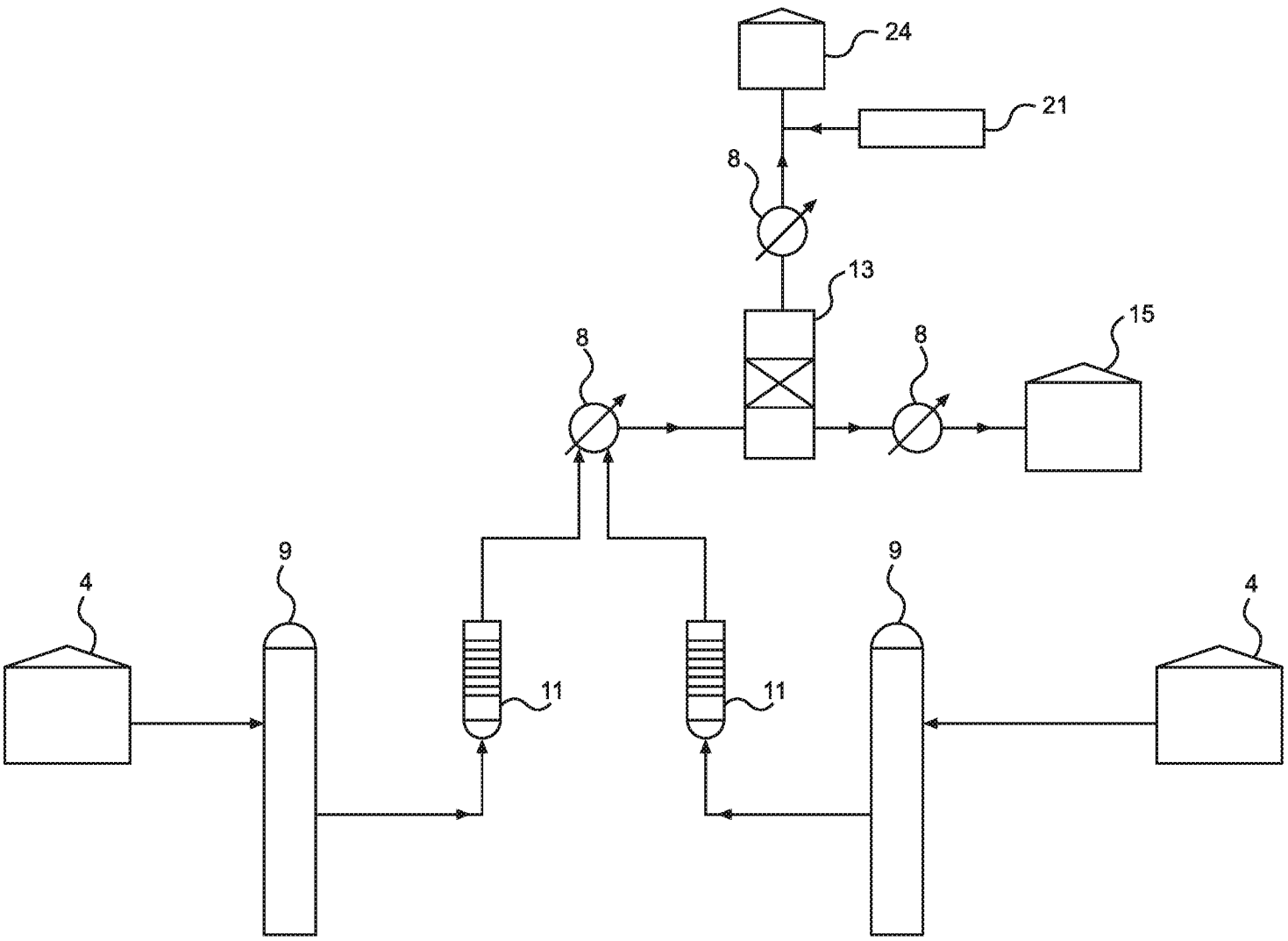
FIG. 3 shows an exemplary process according to certain embodiments herein, with a batch configuration having dual boilers operating independent of each other

FIG. 3 shows another embodiment directed to a batch configuration with two boilers 9 working in tandem; as well as two catalyst towers 11, one corresponding to each boiler.

In certain embodiments PBWO passes through a centrifuge which also removes sludge, solids, asphaltenes or other particles, and the residue is mixed in with the PBWO that looks similar to a tar like substance, and part of the water present. This step in the process has many other strong factors it influences, and can be an important step. Removal of the heaviest components of the PBWO prior to it entering a boiler can yield a cleaner, higher quality product with consistent properties of low sulfur light and medium distillates on the production end of the system. In certain embodiments, prior to entering the pre-heat boiler, the PBWO enters one or more heated holding tanks where PBWO is heated; this allows higher throughput volume from facility.

In certain embodiments gear style pumps are used for transferring PBWO between tanks, rather than centrifugal style pumps which "drive" water into oil and make it more difficult to remove. In certain embodiments, the PBWO is transferred through filters and between tanks, any of which are set up in parallel to add a level of redundancy, so if a pump breaks down, or a filter plugs up the pump and filter flowrate is greatly reduced, PBWO will enter into a bypass route with similar pumps and filtration components.

In certain embodiments, the PBWO is fed into one or more process paths, or process trains. For example, as can be seen in FIG. 3, in certain embodiments, a process according to the present technology includes two process trains (also known as a "production system")—a first "train" containing a first boiler 9 and first catalyst tower 11; and a second "train" containing a second boiler 9 and second catalyst tower 11. In various embodiments, any catalyst tower in any process of the present technology can contain one tray or more than one tray, for example, 2 trays or 3 trays. In various embodiments, any catalyst tower herein can contain one catalyst, or more than one type of catalyst.

As used herein, a process "train" or "production system" is a production increment in the amount of approximately 900 barrels per day. Thus, a process "train" describes an operational set of equipment, a production skid with all required equipment, that is able to produce a given volume, (for example, barrels per day). The design is such that to scale up in size, additional "trains" that can be added, which simply bolt on and scale produced fuels.

In certain embodiments, the trains can be operated in a batch/alternating/cyclical operation—that is, the boilers can each operate independently, and use a batch process or use a 2-stage heating slip-stream process. Specifically, when a first boiler is producing hydrocarbon vapor, a second boiler is being prepared to produce hydrocarbon vapor; when the first boiler is finished producing hydrocarbon vapor (i.e., when the hydrocarbon vapor has substantially all boiled off), the process will be switched over to produce hydrocarbon vapor from the second boiler, and so on back and forth.

While two trains are shown in the embodiment of FIG. 3, in certain embodiments, more than two trains can be used in a process herein. In certain embodiments, the configuration (e.g., the sizing or number of trains) can provide continuous or substantially continuous processing of PBWO, such that the medium distillate fuel output is substantially continuous.

In certain embodiments, PBWO received from the collection tanks in the process that flow into the heated tanks can be stored in one or more tanks. Generally, the process from PBWO to low sulfur diesel fuel in certain embodiments can include any of the following:

(1) PBWO can be conveyed into heating vessel "Kettle" with an internal fire tube burner. In certain embodiments, the PBWO can be optionally pre-heated to some degree in a separate vessel or tank before being loaded into the Kettle, which can further facilitate the batching or switching the process trains.

(2) The PBWO can then be heated in a heating vessel, to, in certain embodiments, 150° C., 100 to 125° C., or 115 to 125° C., to vaporize any water that might have been introduced by moving, storage, contamination or the like. In certain embodiments, the water vapor can be directed to a heat exchanger to cool the water vapor back to liquid, and then can be directed to a holding tank.

(3) Once no more water is being produced, the PBWO can then be heated up to at least 200° C., or up to at least 210° C., or up to at least 250° C., or up to 300° C., to vaporize the PBWO and to produce a light distillate (NGK). This is the "first vapor stream of light end hydrocarbons." The NGK can be directed to a heat exchanger to cool the NGK vapor back to liquid; and then to a holding tank.

(4) The remaining PBWO (this is the "first vapor stream of heavier hydrocarbons") can then be heated further, up to a temperature of at least 250° C., or at least 275° C. or 250 to 300° C., up to 300° C., up to 375° C., 300 to 375° C., 300 to 400° C. or up to 400° C. Once the desired temperature is reached, the PBWO (which can be in the form of a hydrocarbon vapor or liquid, or mixture thereof) can be directed through one or more catalyst towers containing a catalyst supported on one or more trays or beds. In certain embodiments, the catalyst comprises aluminum base (for example, aluminum silicate) with additives, including but not limited to: sulfur absorbing catalysts that assist in sulfur removal from the vapor (or liquid, or vapor/liquid mixture). Such catalysts can include aluminum silicate based catalyst.

(5) As the PBWO vapor exits the catalyst tower, it can pass through one heat exchanger, or a series of heat exchangers, where PBWO hydrocarbon vapor is cooled and quenched back to its liquid form. The liquid form is then collected in one or more holding tanks.

(6) From the holding tanks, liquid hydrocarbons (or diesel hydrocarbon vapor, or diesel fuel) can then pass through a series of particle filters and filter pots in order to remove any particulates, color and odor from the fluid. In certain embodiments, the filter pots contain filter media, which can comprise naturally occurring or not naturally occurring sand or clay.

(7) In certain embodiments, the vaporization process in the Kettle can continue until either of the following occurs:

(a) The level of the liquid PBWO in the kettle drops to a minimum, e.g., within a few inches, e.g., 2 to 6 inches, of the internal fire tube burner, at which point it is turned off, so that the tube does not become exposed, and stays immersed in liquid PBWO; or (b) The maximum temperature of the liquid PBWO in the Kettle reaches, in various embodiments, 375° C. or 400° C. or 410° C. or 415° C., at which point the temperature is held substantially at one or more of such values until the level of PBWO drops to within a few inches of the heating tube. In certain embodiments, if the heater is turned off, any vapor or liquid can continue to flow until the temperature of the oil in the boiler begins to drop. In certain embodiments, the fire tube is not be exposed to air, because doing so can risk baking oil onto its outside surface. Thus, in certain embodiments, the level of PBWO is at least 2 inches, at least 4 inches or at least 6 inches above the top surface of the fire tube.

In a batch process, when either of (a) or (b) occurs, the batch can be deemed "complete."

(8) Once the kettle or boiler is sufficiently cooled (in various embodiments, in the range of below 250° C., or below 225° C., or 200 to 225° C., when further PBWO can be fed into the boiler without getting a large pressure surge), then pre-heated PBWO (in certain embodiments, PBWO at less than 100° C.) from a separate holding tank (not shown in FIGS. 3-5) can be slowly pumped into the Kettle (main boiler), accelerating the cooling process, until the Kettle is filled to a predetermined level, e.g., within 2 feet, or within 5 feet, or from 1 to 2 feet from the top edge of the Kettle, with PBWO. As this is occurring, the other train, e.g., Kettle, can be processing PBWO to light and medium distillate.

Pressure

Through using the distillation system and heat exchanger process layouts of the processes discussed herein, it is advantageously possible to avoid requiring high pressures—that is, pressure systems rated for ANSI #150 or #300, respectively. In such embodiments, vapor that is produced in boilers passes through a series of catalyst beds or expansion tanks, before reaching heat exchangers. The natural cooling and condensing effect that takes place in the heat exchangers or aerial coolers can create a slight pressure drop, resulting in a natural vacuum force, pulling vapor formed in boiler vessels through the system, rather than pushing it through with high pressure. Thus, the processes herein can optimize a natural draft or the volume differential between liquid and vapor to create a natural flow through the system. In various embodiments, the processes herein operate at optimal pressure ranges; for example, any of the equipment discussed herein (e.g., boiler, catalyst tower, stripper, heat exchanger, holding tank) can be kept at pressures of below 15 psi, below 10 psi, below 8 psi, below 5 psi, 4 to 5 psi or 0.5 to 2 psi or 0 to 14.6959 psi. In certain embodiments, one or more of the heat exchangers in the processes operate at a pressure of below 10 psi, below 5 psi, or 0.5 psi to 2 psi.

In certain embodiments, the processes herein, in part or in their entirety, occur at or near atmospheric pressure, or at no greater than atmospheric pressure. As used herein, "atmospheric pressure" means the pressure exerted by the weight of the atmosphere, which at sea level has a value of 101.325 mPa, or approximately 14.6959 psi. As used herein, "near atmospheric pressure" means within 10% of atmospheric pressure. In certain embodiments, the processes herein, in part or their entirety, occur at less than 45 psi, less than 30 psi, less than 15 psi, less than 10 psi or less than 5 psi. In certain embodiments, part or all steps of the methods or processes herein occur at a pressure of no greater than 14.6959 psi (atmospheric pressure). In certain embodiments, part or all of the methods or processes herein can occur within a vacuum—that is, below atmospheric pressure.

In certain embodiments, a process according to the present technology comprises an atmospheric pressure process—that is, at least part of (or all of) any process herein occurs at or near atmospheric pressure, or at values significantly below atmospheric pressure—for example, 0.5 to 5 psi, 1 to 5 psi, 2 to 5 psi 0.5 to 10 psi.

Further Process Embodiments

Turning now to FIG. 1, in certain embodiments, a feedstock storage tank 1 is a large capacity holding tank of raw PBWO. In various embodiments, this is a storage tank of 25,000 barrels (bbl) to 75,000 barrels; for example, a 50,000 barrel storage tank; in other embodiments this can be multiple storage tanks, for example, 50×1,000 barrel tanks, or any configuration of 1,000 barrel tanks connected. The exact configuration will depend on factors such as location or amount of supply of PBWO available.

In certain embodiments, the processes herein can be adapted to process PBWO having a range of water therein; and the amount of water and impurities in the PBWO entering a process herein can affect the amount of time necessary to dehydrate the PBWO in the initial steps of the processes. For example, in certain embodiments, the processes herein can easily handle PBWO having up to 3% water. In other embodiments (for example, under humid conditions), the PBWO entering the processes herein can contain up to 5% or up to 10% water.

From the storage tank or tanks, the feedstock of raw PBWO can go to an optional centrifuge 2, depending on quality of feedstock and how much sludge and contamination it has. In certain embodiments, the centrifuge can be present or absent. In certain embodiments, the PBWO then goes through an optional coarse filter 3 (having, for example, a filter size of 50 microns to 500 microns). In certain embodiments, the coarse filter 3 can comprise a particle and magnetic filter that filters out solid particles. "Particle and magnetic" refers to a coarse particle filter that can filter out particles of approximately 50 to 250 microns, and a magnetic filter where the PBWO passes over magnetic rods and metal shavings can be collected therein.

In certain embodiments, the PBWO (either exiting, in various embodiments, the raw PBWO tank 1, the centrifuge 2 or the filter 3) then enters the clean PBWO tank 4, and in certain embodiments there is an optional mechanism for chemical injection to neutralize the pH of the PBWO. In various embodiments, this can involve adding a base such as, e.g., caustic soda to bring the pH up; or adding an acid to bring the pH down.

In certain embodiments, the product exiting the clean PBWO tank 4 is at ambient temperature. As used herein, "ambient temperature" means the temperate in the geographical location of a facility in which the present processes is located, and is generally limited only by temperatures available worldwide; In various embodiments, "ambient temperature" can encompass temperatures of a variety of ranges, including, e.g., −40 to 40° C., −10 to 30° C., 0 to 30° C., 10 to 30° C., 15 to 30° C., 15 to 25° C., 20 to 30° C. or 20 to 25° C.

In certain embodiments, from the clean PBWO tank 4, the product then enters an optional preheater tank 5; this can assist in separation of water (because in certain embodiments, the product stream at this point is anywhere from 2 to 20% water). In the preheater tank 5, free water can go to the bottom to be removed through a sump (not shown). The sump can drain out the water; oil floats on top and is kept (not shown in FIG. 1). The next step can be the boiler first stage 6, where the oil can be separated out and joins the sump water; this combined water can go to the produced water tank 7 for recovery or recycling. In certain embodiments, a skimmer takes any oil left out of the water, so the water is substantially pure and free of oil. That oil from skimmer can then be put back into raw PBWO, thus increasing the efficiency of a process herein.

In various embodiments, the product flowing from the preheater tank 5 to the boiler first stage 6, can be at a temperature of 20 to 70° C., 30 to 70° C. or 40 to 70° C.

In certain embodiments, one or both of the boiler first stage 6 or boiler second stage 9 has one or more mixers, or a sparging system, or one or more spray nozzles inside to speed up the heating. In certain embodiments, any of these additional features can be fed by either more feedstock being pumped in, or circulation of the existing products in the boiler first stage 6 or boiler second stage 9. This is further shown and described in conjunction with FIG. 5.

In certain embodiments, one or both of the boiler first stage 6 or boiler second stage 9 can also include a pump in one or both ends of the boiler, which reinjects (for example, with jet nozzles) dehydrated PBWO to keep a substantially homogeneous temperature in the boiler. In certain embodiments, a pump pulls liquid PBWO from one end of the boiler (usually the non-burner end) and re-injects that PBWO into a "sparging system," or a pipe along bottom of the boiler that has small holes or jets in it to assist in agitation/mixing of the PBWO in the boiler. This can be seen in, for example, FIG. 5, which illustrates at the far right end of the boiler 9 a PBWO sparging exit stream 38, which is put through a recycle/sparging pump 27, and then optionally mixed with the input PBWO stream 32 from the PBWO feed pump 28; this resultant mixed stream 39 can be re-injected into the boiler 9. Note that in FIG. 5, the boiler is indicated as 9, the boiler second stage (or main boiler) for illustrative purposes; however this embodiment is not so limited, and the system can be included in the boiler first stage (or pre-boiler) 6. This sparging system can be run at different speeds, and can be manually or automatically turned on and off, depending on the specifications of the process and needs of the final product.

In certain embodiments, the product exiting the boiler first stage 6 can then be sent to one or more heat exchangers 8. In various embodiments, one or more of these can be a liquid cooled heat exchanger or air cooled heat exchanger. In certain embodiments, the heat exchanger serves the purposes of cooling down the product. In certain embodiments, the pre-heating boiler in step (a) heats the PBWO from a temperature in the range of 20 to 70° C., up to a temperature in the range of 100 to 120° C. In certain embodiments, the product exiting the boiler first stage 6 is at a temperature of 100 to 120° C., 100 to 130° C., 120 to 130° C. or 120 to 150° C. In certain embodiments, water exiting the boiler first stage 6 goes to a heat exchanger 8, while the PBWO moves to the boiler second stage 9 for additional heating (for example, as shown in FIG. 1, which shows the water exiting on the left side of the boiler first stage 6, while the PBWO exits on the right side of the boiler first stage 6 to enter the boiler second stage 9).

In certain embodiments, in the boiler second stage 9, the temperature is heated to a range of at least 325° C., 300 to 375° C., 300 to 400° C., 325 to 400° C., 300 to 450° C. or 350 to 365° C., or 355 to 365° C. These ranges are found to be a "sweet spot" for temperature in the boiler second stage 9, as it is thought to be the optimal final boiling point for diesel range.

In certain embodiments, there is a sump (not pictured) in boiler second stage 9 as well, to capture any residual water. In certain embodiments, vaporized PBWO goes through a catalyst tower bypass 10 or alternatively through catalyst tower 11. Thus, in various embodiments, the catalyst tower 11 is optional. In the case of a continuous process (slipstream), the process can include a variable frequency drive (VFD), which can pump oil into the two boilers to maintain temperatures or liquid levels. If, on the other hand, the temperatures are high enough, and uniform, the process can provide for the vaporized PBWO to go directly through the catalyst tower 11.

In embodiments involving a batch process, then the boiler second stage can go from a temperature of 120 to 400° C., or 130 to 350° C., or 150 to 360° C.; in such embodiments, the lighter hydrocarbons are the NGK, not a medium distillate product, and can exit the process in a separate output (that is, there is no need to crack through catalyst).

In certain embodiments, in any boiler of a process herein (whether a pre-heat boiler/boiler first stage, or a main boiler/boiler second stage), the light and medium distillates are separated out, and the residue is pumped off the bottom of the boiler as it is in operation; these include the heaviest hydrocarbons, as well as the majority of sulfur species, and can be characterized as "heavies."

In certain embodiments, the first vapor stream of heavier hydrocarbons coming out of the boiler second stage (or the main boiler, or the final boiler, or the only boiler, depending on the number of boilers in the process) includes a certain proportion of C8-C25 hydrocarbon chains; in various embodiments, at least 50%, at least 60%, at least 70%, at least 80% or at least 90%.

As shown in FIG. 1, in certain embodiments, the output for the NGK (the first vapor stream of light end hydrocarbons) is sent through the catalyst tower bypass 10, through another optional heat exchanger 8, and then to an NGK holding tank 32. The remaining product can go to the catalyst tower 11—that is, it does not bypass the catalyst. In other embodiments, both the first vapor stream of light end hydrocarbons and the first vapor stream of heavier hydrocarbons can contact the catalyst.

Thus, one advantage of the processes discussed herein is their ability to be adapted to both batch and continuous processes; this makes them unique when compared to known processes. In certain embodiments PBWO goes into the boiler second stage (or any boiler in any configuration as described herein) and dehydrated PBWO goes out. Any water boiled off as steam goes through a heat exchanger 8 and then is stored in a water tank of produced water 7. In certain embodiments, there is optional skimmer for removing oil from the water tank of produced water 7, and sending it back into the UMO stream. This can greatly improve the efficiency of the processes herein.

In certain embodiments, the product coming out of a catalyst tower 11 is substantially all in the form of vapor; or at least 80% vapor; or at least 90% vapor. In certain embodiments, what exits the catalyst tower is: (i) a second vapor stream of light end hydrocarbons, including one or more of naphthalene, gasoline or kerosene; and (ii) a mixed vapor and liquid stream of heavier hydrocarbons including a certain proportion of C10-C15 hydrocarbon chains; in various embodiments, at least 50%, at least 60%, at least 70%, at least 80% or at least 90%.

As shown further in FIG. 1, in certain embodiments, the product coming out of the catalyst tower 11 then goes through a heat exchanger 8 to decrease in temperature from the range of 300 to 400° C. or 300 to 375° C. or 325 to 415° C., down to a range of 200 to 300° C. or 225 to 325° C. or 225 to 300° C. or 225 to 275° C. In certain embodiments, the product coming out of the tower (a mixed vapor and liquid stream of heavier hydrocarbons) then goes to a stripper 13, which separates the light and medium distillates. As discussed previously, the light end hydrocarbons Naphthalene, Gasoline, and Kerosene are referred to herein as "NGK" and are contained within the broader definition of "light distillate," which in certain embodiments contains a mixture of hydrocarbons with C numbers of C1 to C10, or C5 to C9. Turning back to FIG. 1, thereafter, more NGK can be routed back to a tank, for example, a grade A light ends holding tank 33. In various embodiments, the NGK holding tank 32 and the grade A light ends holding tank 33 can be the same tank, or separate tanks. This can improve the efficiency of the processes herein and permit recovery of more useful products. In certain embodiments, the NGK stream is configured to contact one or more splash trays, which create turbulence and agitation, allowing heavier products to fall and lighter to go upward, leading to still further process efficiency.

In certain embodiments, the stripper temperature is maintained around 100 to 300° C., or 200 to 275° C. or 225 to 250° C.; this has been found to be an optimal temperature range to take out NGK in gas form and medium distillates in liquid form.

In various embodiments, the temperature can be varied based on desired products. Lower temperature generally leads to more diesel; higher temperature generally leads to more lighter fuels like NGK.

In certain embodiments, the outflow from the stripper 13 includes separate vapor and liquid streams. In certain embodiments, the separate liquid stream exiting the stripper includes a certain proportion of C10-C15 hydrocarbon chains; in various embodiments, at least 50%, at least 60%, at least 70%, at least 80%, at least 90% or at least 95% C10-C15 hydrocarbon chains. In certain embodiments, this liquid stream then goes through another optional heat exchanger 8, then to an optional chemical injection skid 14, which is where, in certain embodiments, additives can be added to the process. These can include, but are not limited to: antioxidants, lubricants, cetane modifiers, lubricity boosters and solvents. These can serve to boost the power of the light and medium distillates.

In certain embodiments, the liquid stream exiting this optional heat exchanger after the stripper comprises at least 50%, at least 60%, at least 70%, at least 80%, at least 90% or at least 95% of a medium distillate having C10-C15 hydrocarbon chains.

In certain embodiments, the resultant product exiting the optional chemical skid 14 (or exiting the stripper 13 or condenser 8) is stored in a collection tank 15. If a collection tank 15 sits for a week before sold, atmospheric moisture can build up; therefore, in certain embodiments, the product is put through optional fine particle filter 16, which can further include, in certain embodiments, an optional coalescing filter that can take out any additional residual water.

FIG. 2 shows a detailed schematic of the beginning of an exemplary process herein, having multiple tanks (a manifold system). In certain embodiments, a connection pipe 18 runs down the center and connects to all three tanks 19. FIG. 2 shows three tanks; however, this number is not so limited, and may be 2 tanks, or greater than 3 tanks, depending on the capacity of the setup and the desired amount of PBWO processed. In certain embodiments, the connection pipe 18 collects the PBWO from each tank and pipes the PBWO collectively from the tanks to the boiler system; in others, the connection pipe flows sequentially through each tank, and the PBWO from each tank is successfully added to the flow, which then travels into the boiler system. In certain embodiments, any point along the length of the connection pipe 18 can include one or more of: a pump skid 34, or an optional magnetic and coarse particle filter skid 35 In various embodiments, the tanks 19 hold PBWO at any stage along the process—whether with particulates already removed, or unfiltered, already subject to pre-boiling or never before boiled.

In certain embodiments, the PBWO to be treated can transported to the desired site on rail cars or other vehicles, and can be pumped into manifold that fills any of those tanks, such that the tanks can feed into the system. In certain embodiments, an optional chemical injection skid 14 can be included on the front end (rather than on the back end as shown in FIG. 1), and a partial magnetic filter 3. These elements are optional and can be put in any order with relation to a centrifuge (all of which are optional elements).

In certain embodiments, a process herein can have, for example, twin boiler units and twin catalyst towers. In various embodiments, there can be any number of boiler units. In certain embodiments, the boiler units are provided as twin sets of 2; for example, 6 boiler units, 8 boiler units or 10 boiler units, for example, as show in FIG. 3 and discussed elsewhere in the present disclosure. As discussed elsewhere herein, it has been found that embodiments including twin boilers are particularly advantageous, because, among other reasons, one can be cooling while the other is heating, and vice versa.

In certain embodiments, a process can have an NGK configuration for a batch process. For example, in the embodiment shown in FIG. 1 the system has the option of bypassing the catalyst tower 11. However, FIG. 4 shows a light and medium distillate (e.g., diesel) configuration for a batch process. This embodiment includes twin boilers and twin catalyst towers, as well as a stripper. In the embodiment shown in FIG. 4, the process stream (e.g., the first vapor stream of heavier hydrocarbons coming from a boiler) does not have the option of bypassing the catalyst tower 11, but rather goes through the catalyst tower to heat to desired temperature (in certain embodiments, without the need for heating pads). In certain embodiments, in the stripper 13, there can be a nitrogen injector that creates bubbles in the bottom and releases more light ends that are trapped in surface of the PBWO. In an alternative embodiment, an additional heat exchanger can be present before or after the stripper 13.

In certain embodiments, the processes herein include one or more heat exchangers 8. For example, in certain embodiments, a process can have a cooling system of multiple heat exchangers. Fluid with a high boiling point (including, but not limited to oil) to handle drastic temperatures. In such configurations, the operational range is massive. Commercially available configurations include those known under the trade name Therminol 59 from Honeywell.

FIG. 4 illustrates an exemplary embodiment of another process discussed herein. In the process, PBWO is received at the site and pumped into raw holding tank 1. PBWO is pumped through an optional centrifuge 2, coarse filter and magnetic filter 3 to remove suspended materials such as metals, solids, sludge, and then into a clean PBWO holding tank 4. In certain embodiments, the suspended materials are put into a sludge pit or tank 20.

In certain embodiments, there is an optional chemical injection skid 21 on one or both of the inlet or outlet of the clean PBWO holding tank 4; this can be used to balance the pH of the PBWO prior to its entering the boiler stage. This can extend the equipment life and improve the quality of end products. In certain embodiments, the clean PBWO holding tank 4 will have one or more electric or fired heaters. In various embodiments, this holding tank can heat the PBWO up to, or hold the PBWO at, a temperature of 55 to 80° C., 60 to 75° C., or 60 to 80° C.

In certain embodiments, the PBWO is then pumped into the pre-heat boiler (boiler first stage 6) using a VFD equipped pump that maintains a consistent temperature and liquid level in the boiler. In certain embodiments, this allows at least 2 feet of vapor space between the liquid UMO and the top of boiler at a temperature of 120 to 130° C.

In certain embodiments, water in the PBWO will evaporate from the boiler, pass through a heat exchanger 8 to condense it as it goes to a produced water tank 7. In certain embodiments a skimmer will separate any oil in the produced water tank and pump it to raw UMO holding tank.

In certain embodiments the pre-heat boiler will use mechanical mixers and a recycle sparging system to create agitation or turbulence in the fluid while it is being heated in the boiler; as discussed earlier in the present disclosure, this can help to maintain homogeneous temperature throughout the fluid, and water in PBWO to vaporize during operation of the boiler.

In certain embodiments, the PBWO will be pumped from the pre-heat boiler into an optional storage vessel 22 prior to entering the main boiler 9 (also referred to herein as the boiler second stage). Dehydrated PBWO can then be pumped into the main boiler 9 using a pump equipped with VFD that can ensure the main boiler maintains consistent temperature and fluid level; in certain embodiments this is a temperature of, 350 to 380° C., and a fluid level at least 2 feet from the top of boiler.

In certain embodiments, the main boiler 9 includes one or more mechanical mixers; or a recycle sparging system to create agitation or turbulence in the fluid; this can help to maintain homogeneous temperature throughout the fluid, and allows lighter hydrocarbons to vaporize.

In certain embodiments, the main boiler 9 includes a sump drain that can slowly collect the heaviest hydrocarbons and residual, and can be configured to pump them through a heat exchanger 8 to a residual tank 23, preventing them from building up or solidifying.

In certain embodiments, the hydrocarbons vaporize and pass through a catalyst tower 11. In certain embodiments, one or more types of catalyst are used to crack hydrocarbon chains and remove sulfur. In certain embodiments, the catalyst tower contains a single bed (or tray) of catalyst; in other embodiments the catalyst tower contains two or more beds or trays of catalyst.

Hydrocarbon vapors exiting the catalyst tower are now classified as "light" distillates and "medium" distillates. Specifically, in certain embodiments these are: (i) a second vapor stream of light end hydrocarbons (generally C1 to C7 or C1 to C9 or C1 to C10), including one or more of naphthalene, gasoline or kerosene, or in certain embodiments all three (NGK); and (ii) a mixed vapor and liquid stream of heavier hydrocarbons (C8 and higher). The vapors, whether classified in (i) or (ii), can then pass through a heat exchanger 8 that cools vapor. In certain embodiments, the vapors are cooled to a range of 225 to 250° C., creating a gas, liquid or gas and liquid mixture of light and medium distillates.

In certain embodiments, a stripper (also known as a stripping tower) 13 is used to separate hydrocarbon fractions with different boiling points. The lighter distillates (the vapors) can exit the top of the stripper as a vapor and pass through heat exchanger to condense them back into a liquid before entering the light distillate tank 24. The medium distillates (the liquid stream exiting the stripper) can flow from the bottom of the stripper in liquid form, and pass through a heat exchanger to cool them before entering a medium distillate holding tank.

In certain embodiments an optional chemical injection skid 21 is added to treat product streams with antioxidants and fuel stabilizers. In certain embodiments, one or more of an earth filter, fine particle filter and coalescing filter skid can be included in the process to remove any water or contaminants that may have been introduced in holding tanks, and to remove smell or color.

In certain embodiments herein, the following elements are of note:

One or more of the boilers discussed in the processes herein can include a recycle pump that pulls UMO from one end of the boiler and re-injects it through a "sparging system." As used herein, a sparging system is essentially a header with several nozzles on it that act as jets to assist in creating mixing or agitation, which permits the boiler to maintain a homogeneous temperature. Ideally, the temperature within the boiler will be maintained in a range of less than 450° C., less than 400° C., less than 375° C., or 300 to 375° C. In certain embodiments this sparging system will work with mechanical agitators or mixers to ensure uniform fluid temperature. In certain embodiments, "uniform" temperature means that the temperature within a given system has a temperature variation of no more than 5 to 10% among any two temperature values taken.

In certain embodiments the stripper includes a nitrogen injection mechanism, which injects nitrogen gas ($N_2$) into the bottom of the stripper, and can assist in separation of different hydrocarbon products. In such an embodiment, the nitrogen can break the surface tension of the liquid that is surrounding hydrocarbons with a lower boiling point—that is, the nitrogen bubbles can help lift lighter hydrocarbons trapped in the heavier liquids by breaking surface tension and allowing them to escape.

In certain embodiments PBWO is, at any point in the processes herein, treated with chemical additives to balance the pH. In certain embodiments, this treatment occurs before the UMO enters any of the boilers. In certain embodiments PBWO becomes slightly acidic during its lifecycle, in which case a base is added to neutralize pH at an appropriate stage in the processes herein.

In certain embodiments, medium distillate products of the present embodiments can be used as a cetane booster (boosting additive). Cetane is a colorless liquid hydrocarbon of the alkane series, used as a solvent and a measurement of the tendency of the fuel to ignite spontaneously. A cetane rating (or cetane number) is an indicator of the combustion speed of diesel fuel and compression needed for ignition, playing a similar role for diesel as an octane rating does for gasoline. Old fuel tends to become oxidized and the cetane levels drop, causing the ignition point to be low (and delayed ignition), thus producing less power. In such a situation, a cetane booster can be added into the old fuel to give it a higher ignition point. Any fuel product having a cetane number above 51 is classified as premium diesel. In certain embodiments, the compositions resulting from the processes herein are also advantageous in that they exhibit high cetane ratings. In certain embodiments, the products of the processes herein exhibit a cetane rating of greater than 50, greater than 55, greater than 60, greater than 63, greater than 65, 65 to 70 or greater than 70. This means that there is minimal ignition delay during a combustion cycle, which increases an engine's output.

Advantages of Processes and End Products

Figure 7:
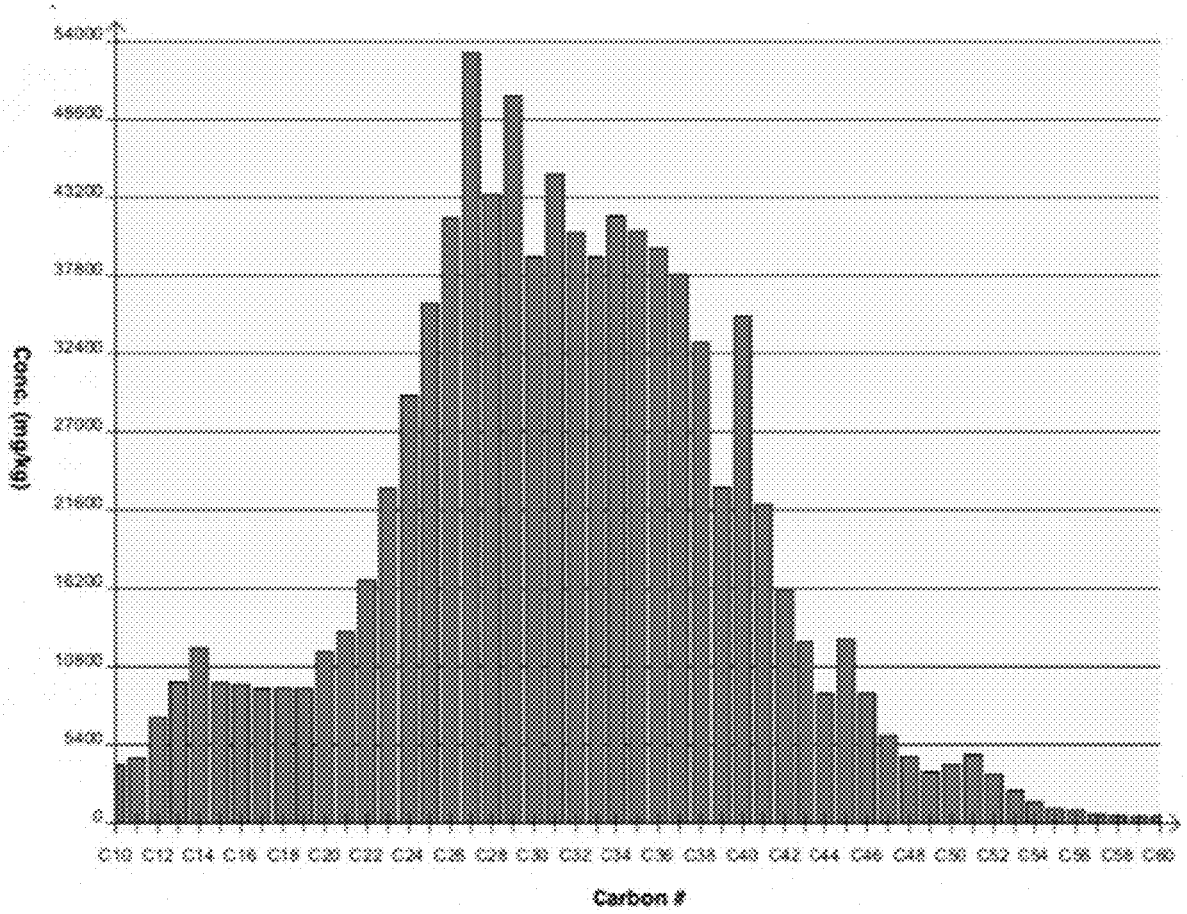
FIG. 7 shows a chart demonstrating the composition of the typical feedstock of PBWO that can be processed through the present embodiments.

The processes described herein exhibit many desirable advantages. Among them, in addition to the ones already discussed herein, are increased efficiency in recycling PBWO and other used oils at lower cost and lower pressures. In particular, looking at FIG. 7, it can be seen that the average C number of an exemplary end product of a process herein is approximately C32. As shown in FIGS. 6*a-b*, one of ordinary skill in the art would expect that temperatures of upwards of 467° C. would be necessary to obtain such end products. In fact, chart shows the average C-Number is around C-32 that has a corresponding boiling point of 467 C. FIG. 7 shows that about 95% of the molecules in the products produced by the processes herein are between C18 and C44. To achieve vaporization of all these molecules, it would be expected to require temperatures of 548° C.

However, it has been surprisingly found that the processes herein are able to achieve vaporization of relatively long hydrocarbon chains (high number of carbon atoms per molecule) without the need to heat up the feedstock to such high temperatures. In certain embodiments, the PBWO process stream never exhibits a temperature higher than 450° C. or higher than 400° at any point in the processes herein. In various embodiments, the PBWO process stream never exhibits a temperature higher than 425° C., 400° C., 375° C., 350° C., 325° C., 300° C. or 250° C.

In certain embodiments, the processes herein can achieve vaporization of larger hydrocarbon molecules well below their respective boiling points, an unexpected benefit. These large molecules can then move into a catalyst tower where they contact the catalyst and are cracked into smaller chains, primarily those in the medium distillate range (corresponding generally with diesel). Another advantage is that the present processes are relatively gentle in their heating of the PBWO, while also successfully achieving high levels of recovery and recycling of the PBWO into usable fuel. In various embodiments, the PBWO is maintained at a temperature of 450° C. or lower. 400° C. or lower, or 370° C. or lower during the entire processes herein. That is, desirable results can be achieved without the need to heat up the PBWO to extremely high temperatures.

In certain embodiments, the processes herein produce light distillate, medium distillate, heavies, diesel fuel or any other hydrocarbons desired as end products. In refining terms, these can refer to any of the following:

Light Distillate—Generally C1 to C10 or C1 to C8 or C1 to C9; includes gasoline, naphtha, jet fuel and petroleum gases; includes but is not limited to NGK; in certain embodiments can encompass a broader range of light distillates.

Medium Distillate—Generally C8 to C25 or C9 to C25 or C10 to C25; includes kerosene, No. 1, No. 2 and No. 4 low Sulphur fuel; No. 2 fuel oil is for heating oil for homes. Medium or middle distillates are commonly referred to as hydrocarbon molecules with number of carbon atoms per molecule corresponding with Kerosene, Jet Fuel, and Diesel (referred to as, "medium distillates" for purposes of this application). Note that there is some overlap between the hydrocarbon ranges for light distillate an medium. In particular, C8-C10 hydrocarbons can be classified in both light distillate and medium distillate.

Heavies—Generally C25 and above; includes marine fuel and furnace oil; in certain embodiments herein is referred to as "residual" or "bunker" and can be in liquid form.

In various embodiments, the present technology is directed to a medium distillate product having at least 80% concentration of hydrocarbons having a chain length of C9-C25, or having a chain length of C10-C15, or having a chain length of C12, and produced with any process herein.

In certain embodiments, another advantage of the present processes is their flexibility in being adapted on a small scale or micro scale basis. For example, in certain embodiments, the processes herein can be part of a micro facility, in that equipment necessary for the processes herein can fit within a few square feet of area, including but not limited to, a shipping container, a modular unit that fits onto a ship or cargo hold of any vehicle. For example, a ship could include its own area for recycling spent oil for continuous use while out to sea; or a household or business could include modular units for accomplishing a process herein that could fit into its back yard to power the energy needs of a family or residential or commercial building. In certain embodiments, a process herein can be accomplished incorporating equipment that fits within a square acre (about 4,000 square meters) or a half square acre (about 2,000 square meters).

Although the present invention has been described in relation to embodiments thereof, these embodiments and examples are merely exemplary and not intended to be limiting. Many other variations and modifications and other uses will become apparent to those skilled in the art. The present invention should, therefore, not be limited by the specific disclosure herein, and can be embodied in other forms not explicitly described here, without departing from the spirit thereof.

We claim:

1. A process for converting petroleum based waste oil (PBWO) to light and medium distillate, the process comprising the steps of:

(a) mixing and heating the PBWO, in a pre-boiler containing a mixer, to a temperature and for a period of time sufficient to remove at least 90% of the water in the PBWO resulting in dehydrated PBWO;

(b) further mixing and heating the dehydrated PBWO, in a main boiler containing a mixer, to at least 300° C. to produce: (i) a first vapor stream of light end hydrocarbons, the light end hydrocarbons including one or more of naphthalene, gasoline or kerosene; and (ii) a first vapor stream of heavier hydrocarbons including at least 50% C8-C25 hydrocarbon chains;

(c) directing the first vapor stream of heavier hydrocarbons from step (b) to a catalyst tower containing an aluminum silicate catalyst to crack the heavier hydrocarbon chains to shorter hydrocarbon chains; to produce: (i) a second vapor stream of light end hydrocarbons, the light end hydrocarbons including one or more of naphthalene, gasoline or kerosene; and (ii) a mixed vapor and liquid stream of heavier hydrocarbons including at least 50% C10-C15 hydrocarbon chains;

(d) directing the mixed vapor and liquid stream of heavier hydrocarbons from step (c) to a stripper that separates the vapor from the liquid to provide separate vapor and liquid streams, wherein the liquid stream exiting the stripper includes at least 60% C10-C15 hydrocarbon chains.

2. The process of claim 1, wherein the PBWO exiting the pre-boiler of step (a) is at a temperature of 100 to 130° C.

3. The process of claim 2, wherein the PBWO exiting the main boiler of step (b) is at a temperature of 300 to 375° C.

4. The process of claim 1, further comprising the step of:

(e) directing the liquid stream exiting the stripper to a heat exchanger.

5. The process of claim 1, wherein the PBWO is maintained at a temperature of 450° C. or lower during the entire process.

6. The process of claim 1, wherein the PBWO is maintained at a temperature of 400° C. or lower during the entire process.

7. The process of claim 1, wherein the PBWO is maintained at a temperature of 375° C. or lower during the entire process.

8. The process of claim 1, wherein all steps of the process occur at a pressure of no greater than 14.6959 psi (atmospheric pressure).

9. The process of claim 1, wherein the medium distillate exhibits a cetane rating of greater than 50.

10. The process of claim 9, wherein the medium distillate exhibits a cetane rating of 65 to 70.

11. The process of claim 1, wherein the pre-heating boiler in step (a) heats the PBWO from a temperature in the range of 20 to 70° C., up to a temperature in the range of 100 to 120° C.

12. The process of claim 1, wherein the main boiler in step (b) heats the PBWO to a temperature of at least 325° C.

13. The process of claim 1, wherein the main boiler in step (b) heats the PBWO to a temperature of 325 to 400° C.

14. The process of claim 4, wherein the liquid stream exiting the heat exchanger comprises at least 70% of a medium distillate having C10-C15 hydrocarbon chains.

15. The process of claim 14, wherein the liquid stream exiting the heat exchanger comprises at least 80% of a medium distillate having C10-C15 hydrocarbon chains.

16. The process of claim 1, wherein the mixer in the pre-boiler or the mixer in the main boiler operates at a speed of 2 to 250 RPM.

17. The process of claim 1, wherein the mixer in the pre-boiler or the mixer in the main boiler agitates the PBWO for at least 50% of the time any PBWO is within the pre-boiler or main boiler.

18. The process of claim 17, wherein the mixer in the pre-boiler or the mixer in the main boiler agitates the PBWO for at least 80% of the time any PBWO is within the pre-boiler or main boiler.

* * * * *